US005942006A

United States Patent [19]

Cole

[11] Patent Number: 5,942,006

[45] Date of Patent: Aug. 24, 1999

[54] PROCESS FOR THE FLAME-RETARDANT TREATMENT OF TEXTILES

[75] Inventor: Robert Cole, West Midlands, United Kingdom

[73] Assignee: Albright & Wilson UK Limited, West Midlands, United Kingdom

[21] Appl. No.: 08/904,238

[22] Filed: Jul. 31, 1997

Related U.S. Application Data

[63] Continuation-in-part of application No. 08/465,126, Jun. 5, 1995, abandoned, which is a continuation of application No. 08/153,793, Nov. 17, 1993, abandoned, which is a continuation of application No. 07/738,833, Aug. 1, 1991, abandoned.

[30] Foreign Application Priority Data

Aug. 10, 1990 [GB] United Kingdom ..... 9017537

[51] Int. Cl.[6] ..... D06B 19/00; D06B 23/16

[52] U.S. Cl. ..... 8/111; 8/116.1; 8/127.1; 8/127.5; 8/127.6; 8/128.1; 8/129; 8/181; 8/182; 8/115.54; 8/115.55; 8/115.64; 8/115.65; 8/115.66; 8/115.69; 427/393.3; 427/345; 442/141; 442/142; 442/143; 442/144

[58] Field of Search ..... 8/116.1, 127.1, 8/127.5, 127.6, 128.1, 129, 181, 182, 115.54, 111, 115.55, 115.64, 115.65, 115.66, 115.69; 427/393.3, 345; 252/8.61, 8.84, 8.85, 8.86; 442/141, 142, 143, 144

[56] References Cited

U.S. PATENT DOCUMENTS

| | | | |
|---|---|---|---|
| 3,982,410 | 9/1976 | Getchell et al. | 68/5 E |
| 4,068,026 | 1/1978 | Wagner | 8/127.1 |
| 4,123,574 | 10/1978 | Wagner | 8/127.1 |
| 4,137,346 | 1/1979 | Wagner | 8/127.1 |
| 4,154,890 | 5/1979 | Wagner | 8/127.1 |
| 4,156,747 | 5/1979 | Wagner | 8/127.1 |
| 4,909,805 | 3/1990 | Smith | 8/127.1 |
| 5,468,545 | 11/1995 | Fleming et al. | 428/259 |
| 5,480,458 | 1/1996 | Fleming et al. | 8/115.58 |

FOREIGN PATENT DOCUMENTS

| | | |
|---|---|---|
| 294234 | 12/1988 | European Pat. Off. . |
| 740269 | 11/1955 | United Kingdom . |
| 1439607 | 6/1976 | United Kingdom . |
| 1439608 | 6/1976 | United Kingdom . |
| 1439609 | 6/1976 | United Kingdom . |

*Primary Examiner*—Alan Diamond
*Attorney, Agent, or Firm*—Frishauf, Holtz, Goodman, Langer & Chick, P.C.

[57] ABSTRACT

A process for the flame-retardant treatment of a cellulosic fabric by impregnating a fabric with an aqueous solution of a tetrakis (hydroxyorgano) phosphonium (THP) and then at least partially drying it. The partially dried impregnated fabric is passed at a speed of 30 to 100 m/minute once through a chamber containing ammonia for a single cure. Both the moisture contained in the fabric and water produced as a by-product of curing are volatilized and condensed on an interior wall of the chamber and flow down the walls to a drain for removal of the condensed water from the apparatus. The process further includes measuring the rate of ammonia in the gas fed into the chamber, determining the ammonia content of the gas and measuring the temperature within the chamber, for maintaining the initial concentration of ammonia in the gas at 70% to 90% by volume and for maintaining the ratio of ammonia input to the THP composition in the range of at least 1.2 to 1, on the basis of ammonia to phosphorus; withdrawing the treated fabric from the chamber, removing at least some of the gas from the chamber; and recycling at least some of the gas back into the chamber.

27 Claims, 1 Drawing Sheet

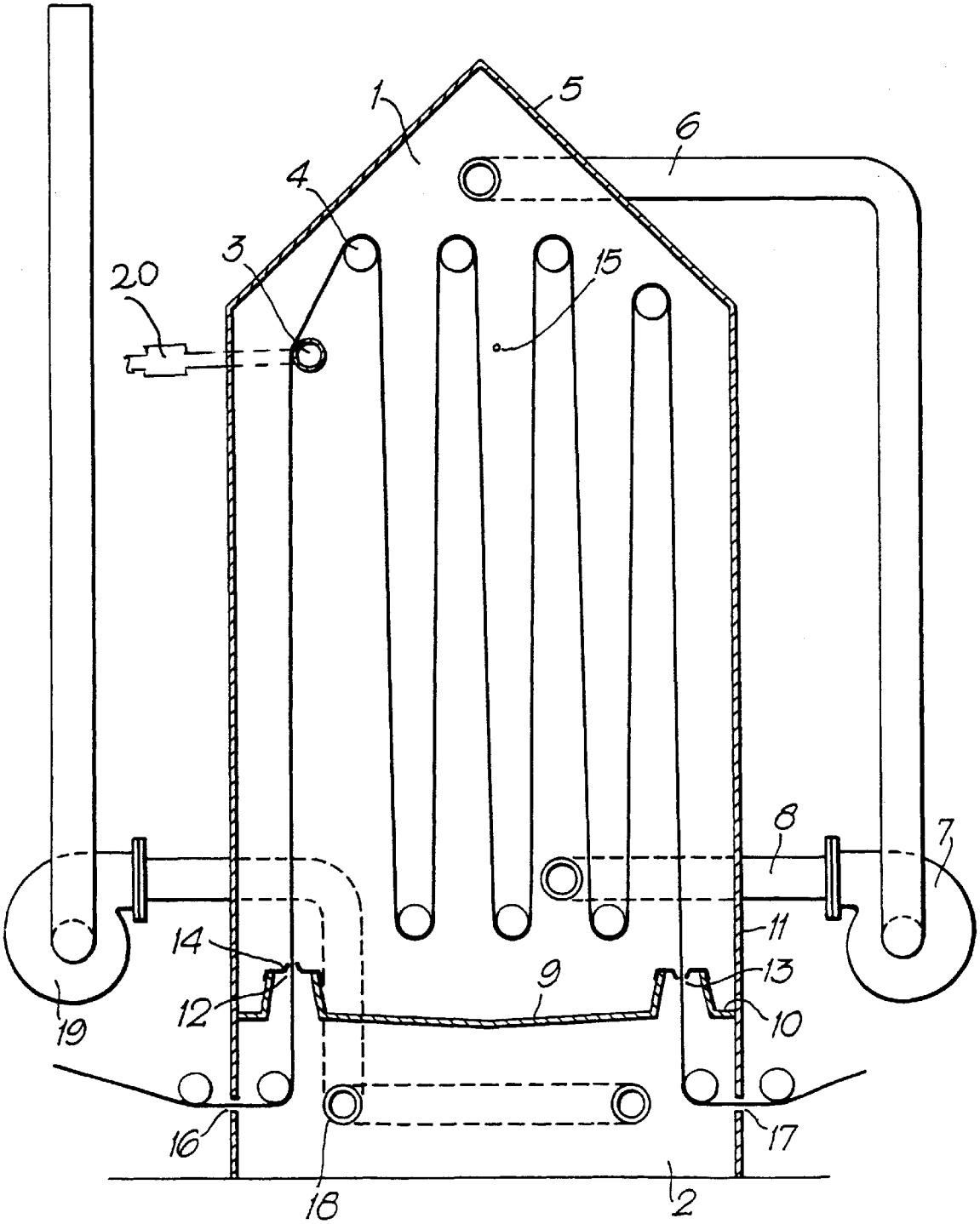
1
5
6
4
3
20
15
8
7
11
14
9
13
12
10
19
16
17
18
2

PROCESS FOR THE FLAME-RETARDANT TREATMENT OF TEXTILES

This application is Continuation-In-Part, of application Ser. No. 08/465,126, filed Jun. 5, 1995, now abandoned which is a continuation of application Ser. No. 08/153,793, filed Nov. 17, 1993 abandoned, which is a continuation of application Ser. No. 07/738,833 filed Aug. 1, 1991 abandoned.

BACKGROUND OF THE INVENTION

This invention relates to an apparatus for use in the flame-retardant treatment of textiles, in particular cellulosic textiles and to a process employing said apparatus.

BACKGROUND INFORMATION

Cellulosic textiles are generally rendered flame-retardant by impregnation with an aqueous solution of a tetrakis (hydroxyorgano) phosphonium (THP) composition. The THP composition may be a THP salt, a partly-neutralized derivative thereof or a condensate with a nitrogen- containing compound such as urea. Impregnation with the THP composition is followed by drying and curing with ammonia gas to produce a cured, water-insoluble polymer in association with the textile. The ammonia gas may be passed directly into a chamber through which the textile fabric passes, or, preferably, the ammonia gas is forced through the fabric inside the chamber. In our earlier patents GB-A-1439608 and GB-A-1439609, there are described preferred apparatus, which consists of a closed chamber, entry and exit seals thereto through which the fabric moves, a duct located in the chamber and having one or more orifices through which gaseous ammonia issues and subsequently passes through the fabric passing over each orifice, the chamber having means to prevent condensed water from dripping on to the fabric.

The apparatus has several disadvantages, notably it is not capable of giving a satisfactory cure at processing speeds in excess of about 20 meters/minute; the level of curing can sometimes be less than ideal so that retreatment of the fabric may be necessary; and the relatively large amounts of ammonia which are used result in the loss of ammonia to the atmosphere, with resultant atmospheric pollution.

SUMMARY OF THE INVENTION

The present invention provides an improved apparatus which is capable of operating at higher processing speeds; which gives a consistently high level of curing efficiency which is not susceptible to variation with wide variations of processing parameters such as fabric speed, fabric moisture content, ammonia concentration, and curing temperature; and which utilizes an optimal amount of ammonia for achieving the cure so that the quantities of ammonia employed are considerably reduced and environmental pollution is minimised.

Accordingly, the present invention provides, in one aspect, an apparatus for the flame-retardant treatment of a cellulosic fabric by subjecting the fabric to the action of a gas including ammonia, in which said apparatus comprises a chamber, an entry into and an exit from said chamber for said fabric, at least one duct located in said chamber and having at least one orifice which (or the totality of which) extends over the width of the fabric, means to cause the fabric to travel in contact with said duct and over said orifice, means for measuring the rate of ammonia fed into the chamber, recycling means adapted to remove at least some of said gas from the chamber and to return gas thereto, means for analysing the ammonia content of the gas, and means for measuring the temperature within the chamber.

In a second aspect, the present invention also provides a process for the flame-retardant treatment of a cellulosic fabric in which said process comprises impregnating the fabric with an aqueous solution of a tetrakis (hydroxyorgano) phosphonium (THP) composition, at least partly drying the impregnated fabric and then treating it with a gas including ammonia in said apparatus and passing the treated fabric from the apparatus, at least some of said gas being removed from the apparatus and subsequently recycled thereto during said process.

The present invention also provides a fabric which has been treated in the apparatus, and a fabric which has been rendered flame-retardant according to the process, both as hereinabove described.

BRIEF DESCRIPTION OF THE DRAWINGS

The FIGURE is a perspective view in partial cross-section of an apparatus according to the present invention.

DETAILED DESCRIPTION OF THE INVENTION

The essential features of the process are that the ammonia feed rate is precisely controlled relative to the amount of fabric being processed and that the curing chamber is pre-filled with ammonia to provide a reservoir of ammonia to allow for any slight variation in the ammonia usage relative to the ammonia input. Under these conditions the temperature in the chamber gradually increases and the concentration of ammonia in the chamber gradually decreases until they both reach a steady-state condition. When this steady state is reached the ammonia usage is in balance with the ammonia input, which has been adjusted to ensure complete polymerisation of the THP compound with minimal carry-over of unreacted ammonia.

It is not essential to control the precise ammonia concentration or the chamber temperature at the steady-state condition. By always starting from a lower temperature and a higher concentration of ammonia we ensure that at the steady-state, i.e until a balance is achieved we ensure that curing is complete although this means that there is a slight carry-over of excess ammonia.

However, in areas where cold weather occurs, such as northern USA, Britain and northern Europe, preheating the ammonia to a temperature of at or below equilibrium (about 60° C.), preferably from about 40° C. to about 50° C., has a number of advantages:

(i) First, preheating the ammonia reduces and minimizes condensation of water on the internal surfaces of the chamber in which the curing of the THP composition on the impregnated fabric, is accomplished. Condensation can be a major practical impediment to a commercial operation since it is known to drip on the fabric passing through the chamber, causing generally unacceptable "marking" of the fabric. Moreover, the marking is very difficult to remove without damaging the THP composition and/or the fabric.

(ii) Although preheating the ammonia to a temperature of about 40° C. to about 50° C. does not change the naturally occurring exothermic reaction taking place in the chamber as it reaches "steady state," preheating has the effect of more quickly bringing the chamber close to "steady state" so that efficiency of subsequent curing of the fabric is maximized. The result is an increase in efficiency of time, in that one does not have to wait for the chamber to reach equilibrium; and there is an increase in efficiency in use of ammonia. That is, one does not have to wait to start the fabric passing through the chamber or, alternatively, there is less wasted fabric if one starts before equilibrium is reached. Furthermore, there is increased efficiency in the use of ammonia so that as little as 35% ammonia concentration in the chamber atmosphere, can be used and a single pass of material through the chamber can produce adequately treated fabric. In addition to time and cost savings, the reduction in ammonia pollution (escape into the atmosphere) can be greatly reduced in order to meet local environmental laws. It has been found that the maximum level tolerated by the Netherlands law (strictest in Europe) can be met with levels well below their legal maximum.

A further advantage of the preheating feature is that it enables the apparatus to be used for the treatment of what are called "development lengths" of fabric. Such "development lengths" are of the order of 300 meters long and are passed through the apparatus at a speed of 40 m to 50 meters/minute. If it were intended to rely upon the chamber reaching "steady state" without preheating, it would take 20–30 minutes (far longer than the 6 minutes or so that the 300 m length takes to pass through the chamber). Alternatively, the continuous passage of fabric through the chamber while equilibration was taking place would require up to 1000 meters of fabric to pass before "steady state" was reached.

Each of the exit and entry points for the fabric is preferably sealed, in a substantially gas-tight manner, by means of flexible (e.g. rubber) seals or flaps. In the chamber there is at least one duct for conveying ammonia gas into the chamber, the duct having at least one orifice or perforation through which the ammonia passes into the atmosphere of the chamber, by way of the fabric moving over the orifice or perforation. Each perforation may be of round, square, rectangular or elliptical shape, and may be, for example, in the form of a series of slots or a single slot. Preferably, the orifices extend across substantially the whole width of the fabric, whereby substantially all the ammonia passes through the fabric.

In order to process fabrics of different widths, it is thus preferred to have suitable plates or covers to close those portions of the orifices not covered by the narrower fabrics. The chamber may contain from one to four ducts, each with one or more orifices emitting ammonia through the fabric. Preferably, means are provided to maintain the contact-angle between fabric and orifice at less than 60°. While the duct or ducts may be located anywhere in the chamber, they are preferably at a location such that the ammonia is forced through the fabric shortly after the fabric enters the chamber. As well as treatment with ammonia forced through the fabric at the ducts, the fabric also preferably passes through the atmosphere of ammonia gas and water vapour which will be present in the chamber. The chamber is preferably fitted with a plurality of rollers, which may be powered or idling, so that the fabric can pass in a serpentine configuration over the rollers. After passage through the atmosphere in the chamber the cured fabric leaves the chamber via the exit point.

The fabric entering the chamber generally contains some moisture and the curing reaction also produces water as a by-product; this water, together with that entering in the fabric, volatilize in the chamber as steam, owing to the heat of the curing reaction. The steam concentration in the chamber is preferably kept to a minimum, and this may be achieved by allowing condensation of the steam on the internal walls of the chamber, preferably associated with means to prevent condensed water from dripping on to the fabric. This prevention means may comprise a sloping roof to the chamber, together with means for collecting the condensed water at the bottom of the chamber without contact with the fabric, such as a circumferential gully or drain. The condensed water may be retained within the chamber but is preferably continuously removed from the chamber. Also, as discussed above, the condensation of steam can be minimized, by preheating the ammonia to a temperature preferably in the range of about 40° C. to about 50° C.

The gases in the chamber, comprising ammonia and steam, may be passed outside the chamber by way of an exhaust pipe and subsequently returned to the chamber at a position remote from the exhaust pipe, preferably in the lower portion of the chamber. The return may be by way of a perforate duct over which the fabric passes, but preferably by way of a perforate pipe emitting the gases into the atmosphere of the chamber. Advantageously the exhaust pipe is located in the chamber near one or more of the ducts carrying the orifices through which fresh ammonia is forced through the fabric, as this is the location of the maximum heat and steam emission.

The ammonia duct and exhaust pipe are preferably both located in the upper portion of the chamber, while the return pipe is preferably located in the lower portion of the chamber. Alternatively, the ammonia duct or the exhaust pipe may be located in the lower portion of the chamber. The exhaust and return of gases may be in association with means to condense water in the chamber, but in addition (or alternatively) the exhaust gases may be passed through a cooler to reduce their water content prior to return of the gas to the chamber. The gas returning to the chamber may be at about the same temperature as that leaving via the exhaust pipe but is preferably cooler. When the gases are cooled externally, the chamber may be fitted with a heated jacket to reduce condensation in the chamber.

A cooling jacket may also be used to increase condensation on the chamber walls, thereby reducing or eliminating the need for external condensation means. However, the recycle exhaust and return line for the ammonia would still be present in order to render more uniform the ammonia concentration within the chamber. The apparatus of the present invention also contains means for sampling the atmosphere within the chamber, in order that appropriate adjustments may be made to the input feed rate for ammonia, to ensure that a steady ammonia concentration is maintained. An I/R Analyser, such as the ANAKRON PROCESS INFRA-RED ANALYSER 206 (available from ANAKRON), can be used as a means for analysing the ammonia content in the chamber for maintaining a steady ammonia concentration.

As a practical matter, any known modification to protect the analyser cell from the adverse effects of steam, should be used to ensure longer effective life of the analyser (e.g. electric-tracer heaters in the sampling-lines coming from the chamber, to prevent condensation of steam).

The chamber is preferably mounted on a base which defines a lower compartment, with which the chamber fabric entry and exit points are in substantially gas-tight contact. This lower compartment is also provided with fabric entry and exit points, together with a compartment exit vent, which preferably is under the reduced pressure of an external suction fan.

To use the apparatus the cellulosic fabric is first impregnated with a tetrakis (hydroxyorgano) phosphonium composition. The cellulosic fabric is preferably substantially all cellulosic but may comprise cellulose fibres and other fibres coblendable or coweaveable therewith. The non-cellulosic fibres are preferably polyester or polyamide fibres but may also be acrylic (especially modacrylic fibres). The polyamide fibres may be aliphatic, such as copolymers of alkylene diamines and alkylene dicarboxylic acids (eg. nylon 66) or polylactams (such as nylon 6), or may be aromatic, such as aramid, based on aromatic dicarboxylic acids and phenylene diamines.

The fabric can contain at least 30% of cellulosic fibres and up to 70% of coblendable fibres (e.g. 10–70% and especially 25–60% of coblendable fibres), such as polyamide fibres. Particularly important blended fabrics are those containing cellulosic fibres and polyester fibres. The blended fabric suitably contains up to 70% (e.g. up to 60%) of polyester fibres and from 30%, e.g. from 40% upwards, of cellulosic fibres (e.g. 1–70% or 1–60%, such as 15–60%, particularly 22–38% or 38–60% polyester fibres and 30–99% or 40–99% such as 40–85%, particularly 62–78% or 40–62% cellulosic fibres).

Blended fabrics comprising 40–78% cellulosic fibres and 22–60% polyester fibres or 30–62% cellulosic fibres and 38–70% polyester fibres are preferred. The cellulosic fibres are preferably natural cotton, but may be ramie, flax or regenerated fibres e.g. viscose or cuprammonium fibres. The polyester may be a condensation product containing structural units from an aliphatic alcohol (e.g. a dihydric alcohol such as ethylene glycol) and an aromatic dicarboxylic acid (e.g. terephthalic acid).

The fabric may be non-woven, but is preferably woven. The cellulosic and other fibres may be an intimate or non-intimate mixture, but the fibres are preferably in the form of a blend of cellulosic fibres and other fibres (e.g. polyester fibres), as in a cospun blend such as cotton/polyester staple fibre. Alternatively, the fibres, may be in the form of core spun yarn, with a core of, for example, polyester sheathed in cotton fibres. In a fabric, the warp and weft fibres are preferably the same, but may be different e.g. one may be of cotton fibres and the other of polyester/cotton fibres. Thus in this specification the term "blend" also includes unions and union/blends as well as core sheath fibres. The fabric is preferably one with a weight of 100–1000 g/m$^2$ e.g. 150–400 g/m$^2$, such as cotton polyester shirting or sheeting or curtain fabric.

In the tetrakis (hydroxyorgano) phosphonium compound, each hydroxyorgano group is preferably an alpha-hydroxyorgano group having from 1 to 9 carbon atoms, especially one of formula HOC($R^1R^2$)— wherein each of $R^1$ and $R^2$ (which may be the same or different) represents hydrogen or an alkyl group having from 1 to 4 carbon atoms, e.g. methyl or ethyl. Preferably $R^1$ is hydrogen and especially both $R^1$ and $R^2$ are hydrogen, as in tetrakis (hydroxymethyl) phosphonium compounds.

The use of tetrakis (hydroxyorgano) phosphonium compounds in general will hereafter be illustrated with respect to tetrakis (hydroxymethyl) phosphonium (THP) compounds, but corresponding molar amounts of other tetrakis (hydroxyorgano) phosphonium compounds may be used.

The THP composition is preferably a THP salt mixed with a nitrogen-containing compound condensable therewith, such as melamine, methylolated melamine or urea, or a precondensate of said THP salt and said nitrogen-containing compound, or a THP salt or at least a partly neutralized THP salt, e.g. THP hydroxide, with or without said nitrogen-containing compound.

The THP composition is preferably a precondensate of a THP salt, e.g. THP chloride or THP sulphate and urea, in a molar ratio of urea to THP of 0.05 to 0.8:1, e.g. 0.05 to 0.6:1, such as 0.05 to 0.35:1 or 0.35 to 0.6:1, and is in aqueous solution, usually with a pH of 4 to 6.5 e.g. 4 to 5.

The concentration of organophosphorus compound in the aqueous impregnating solution may be 5 to 50% (expressed by weight as $THP^+$ ion), e.g. 15 to 35%, especially 15 to 25%. If desired, the solution may contain a wetting agent, e.g. a nonionic or anionic wetting agent.

The fabric is impregnated with the THP solution and the wet fabric squeezed to a wet-pick up of 30 to 130%, e.g. 60 to 100% (based on the original weight of the fabric). The fabric after impregnation usually has an organophosphorus pick-up of less than 40% e.g. 10 to 40% such as 10 to 30% (e.g. 15 to 30% and especially 15 to 25% as $THP^+$ ion), based on the original weight of the fabric.

The impregnated fabric is then dried e.g. to a moisture content of 0 to 20%, e.g. 5 to 15%, such as about 10%, the percentage being calculated from the increase in weight of the fabric and the weight of chemicals impregnated. The drying may be in a stenter oven or over heated cans e.g. steam cans and may involve heating at 80 to 120° C. for 10 minutes to 1 minute.

The dried fabric then enters the apparatus of the present invention where it is cured with ammonia. Preferably, the fabric passes through the lower compartment fabric entry point, then through the lower compartment and finally enters the chamber via the chamber entry point. The fabric is then passed over the orifices and ammonia is forced through it.

Subsequently the fabric travels through the ammonia/water vapour atmosphere in the chamber, prior to leaving via the fabric chamber exit point, and (if present) through the lower compartment and lower compartment fabric exit point.

When the operation is started, the chamber is filled with ammonia which displaces the air through the fabric entry and exit points and also though additional vents in the base of the chamber which may be provided for this purpose, until the ammonia concentration is at least 40% by volume (as determined be means of the sampler and analyzer). The initial ammonia concentration is preferably set at a high level (70% to 90%), in order to provide a reservoir of ammonia which is used to compensate for the higher ammonia usage during the initial warm-up period.

The fabric is then passed through the chamber using an ammonia feed-rate calculated to provide sufficient ammonia to ensure maximum chemical reaction plus a small margin to allow for the loss of unreacted ammonia. The molar relationship between the ammonia input and the phosphorus in the THP composition on the fabric is at least 1.2:1 and preferably between 1.7:1 and 2.2:1 (when the THP composition is a condensate of THP salt and nitrogen-containing compound such as urea) or at least 1.7:1 and preferably between 2.2:1 and 2.7:1 (when the THP composition is a THP salt per se or a partially neutralized derivative thereof).

During the initial stage of curing the ammonia usage slightly exceeds the ammonia feed rate and the cured fabric takes out from the chamber an excess of unreacted ammonia. The ammonia concentration in the chamber falls during this initial stage, but, provided that the exposure time and the concentration remain sufficiently high, this does not reduce the ammonia uptake by the fabric. Heat and steam are produced in the reaction and the temperature within the chamber rises. The ammonia uptake by the fabric drops as the temperature rises and the chamber eventually reaches a steady-state condition. Preheating the ammonia from about 40° C. to about 50° C. can greatly reduce this initial stage, reducing the concentration of ammonia required at initial stages; and reducing the loss of excess unreacted ammonia.

Under steady-state conditions the ammonia concentration and the chamber temperature will remain substantially constant and the ammonia usage will balance the ammonia feed-rate. The selected ammonia feed rate determines the ammonia usage, which is independent of the ammonia concentration.

The cure chamber usually contains 1 to 20 m (e.g. 10 to 20 m) of fabric, moving at a speed of 5 to 100 m/min (e.g. 30 to 100 m/min and especially 50 to 80 m/min). The cure chamber contains sufficient fabric to give an exposure time of at least 4 seconds and preferably 10 seconds at the required fabric speed. The volume of the cure chamber should be at least 1.5 times the maximum volume of ammonia to be fed per minute. The fresh ammonia gas is preferably undiluted, but may be diluted with up to 30% by volume of steam or air. The ammonia gas issuing from the duct into the chamber may be at 10 to 120° C. but is preferably at a temperature below 100° C., eg 40° C. to 50° C.

After the cured fabric has left the cure apparatus, the fabric is preferably treated with an oxidising agent in order to convert at least some of the trivalent phosphorus in the THP composition to pentavalent phosphorus in the cured resin, followed preferably by neutralization with an aqueous solution of a base and washing with water. The oxidizing agent is preferably a peroxy compound, such as aqueous hydrogen peroxide solution. Alternatively, the oxidation may be performed with a gas containing molecular oxygen, (preferably air) and particularly by the gas being drawn or blown through the fabric. Thus, the fabric can be passed over a vacuum slot or perforate tube through which the oxidising gas is blown or sucked.

A preferred embodiment of an apparatus according to the present invention will be illustrated, merely by way of example, in the following description and with reference to the accompanying drawing. In the drawing, there is shown schematically a vertical section through the apparatus.

The apparatus has an upper chamber 1 and a lower compartment 2. Inside chamber 1 is a gassing tube 3 having perforations (not shown) and rollers, exemplified at 4. Chamber 1 has a sloping roof 5, at the apex of which is an exhaust pipe 6 leading from the chamber 1 via a condenser (not shown) and an exhaust fan 7, through a gas return line 8 which leads back into the chamber. The chamber 1 has a dished floor 9 with an annular or circumferential gully 10 against the wall 11 of the chamber 1. On either side of floor 9 are fabric entry 12 and fabric exit 13 slots, substantially sealed with rubber flaps 14. Ammonia sampling point 15 is located in the upper part of chamber 1. If desired, sampling lines communicating with a port at sampling point 15 carry samples of the chamber atmosphere to an I/R Analyzer to determine the ammonia concentration;

In the wall 11 of the lower compartment 2 there are provided a fabric entry slot 16 and a fabric exit slot 17, and near to exit slot 16 a gas exit slot 18, leading to an exhaust fan 19. Compartment 2 also contains rollers 4.

Chamber 1 also preferably has one or more resealable panels (not shown) which can be removed to allow access to the gassing tube and rollers. Alternatively, the chamber may be made in two parts, one of which may be removed to allow access.

In use impregnated fabric enters the apparatus via slot 16, compartment 2, entry slot 12 and thence into chamber 1. The fabric passes over gassing tube 3 through whose perforations ammonia issues through the fabric. The fabric then passes over the rollers 4 through the atmosphere of ammonia and steam and thence out of chamber 1 via exit slot 13 compartment 2 and exit slot 17. Ammonia steam is if desired sucked by a fan 7 out of chamber 1 via exhaust pipe 6 and if desired water is condensed by a condenser (not shown) before the gas is returned by line 8 and is emitted into chamber 1; any condensate leaves via a condensate line (not shown).

Steam condenses on walls 11 and is collected in gully 10, from which it is periodically drained (by means not shown). Any excess of ammonia, together with entrained air and residual water vapour, leaves chamber 1 via the fabric entry and exit slots 12 and 13 and, with any entrained air and ammonia from the exiting fabric, are sucked out of compartment 2 via slot 18. If desired, the amount of condensation can be minimized by preheating the ammonia with heater 20 (optionally provided), to about 40° C. to about 50° C. before introduction into the chamber. Alternatively, or in addition, the ammonia can be heated after introduction into the chamber.

The process of the present invention is illustrated by way of the following Examples:

EXAMPLE 1

A precondensate of tetrakis (hydroxymethyl) phosphonium chloride (THPC) and urea was prepared, having a molar ratio of urea to THPC of 0.5:1.0. The precondensate was diluted with water to give a solution containing the equivalent of 25% $THP^+$ ion. A bleached white cotton drill, weighing 280 g/m$^2$, was padded through this solution to give approximately 80% wet pick-up. The fabric was dried for 1 minute at 100° C. It was then cured in a scaled-down version of the apparatus holding 1.2 meters of fabric 0.45 meters wide, using an ammonia input rate of 1.7:1 ammonia to phosphorus and an exposure time of 14.4 sec. The ammonia concentration in the apparatus was adjusted to different levels before curing commenced. The cured fabric was jig-washed in a cold solution of 55 g/1 hydrogen peroxide, then in 2 g/1 sodium carbonate solution at 60° C., and finally in cold water before drying.

Samples were taken after curing and after final drying and analysed for phosphorus and nitrogen content. The results are given in TABLE 1 (below).

TABLE 1

| % Ammonia concentration | N/P increase on cure | % P efficiency |
|---|---|---|
| 40 | 1.66 | 91.7 |
| 50 | 1.64 | 92.3 |
| 55 | 1.64 | 91.4 |
| 65 | 1.69 | 92.3 |
| 75 | 1.67 | 91.7 |

EXAMPLE 2

5 meter lengths of drill fabric were treated as described in Example 1 but using instead a bath containing the equivalent of 22.5% $THP^+$ ion, an exposure time of 24 secs., and an initial ammonia concentration of 80%. The ammonia input rate was either 1.7 to 1 or 2.2 to 1 ammonia to phosphorus. With an input ratio of 1.7:1, the ammonia concentration fell to 69%, but with an input of ratio of 2.2:1: the ammonia concentration remained constant at 80%. Samples were taken from both ends of each fabric and the results are given in TABLE 2 (below).

TABLE 2

| Ammonia/P ratio | Ammonia conc. | N/P increase on cure | % P efficiency |
|---|---|---|---|
| 1.7 start | 80 | 1.85 | 93.6 |
| 1.7. end | 69 | 1.84 | 89.9 |
| 2.2 start | 80 | 1.85 | 91.9 |
| 2.2 end | 80 | 1.83 | 93 |

EXAMPLE 3

A precondensate as described in Example 1 was diluted to 27.7% $THP^+$ ion content. 1000 meters of dyed cotton drill weighing 266/gm$^2$ and 1.52 meters wide was padded through this solution to give a wet pick-up of 70.3%. The fabric was dried on a four-bay stenter to about 12% moisture content. It was then cured in the cure apparatus (holding 13 meters of fabric). Initially the ammonia concentration was 76%, the speed was set at 32 meters/min and the ammonia flow-rate at 2.2 $NH_3$/P. During this stage the temperature rose to 60° C. and the ammonia concentration fell to 67% before rising to 69%.

The processing speed was then increased to 39 meters/min and the relative ammonia flowrate reduced to 1.8 $NH_3$/P. The temperature continued to rise to 77° C. and the ammonia concentration first fell to 68% and then rose to 83%.

The fabric was then washed with hydrogen peroxide, soda ash and water in a continuous wash range and dried.

13 samples were taken at regular intervals throughout the run. All the samples met the requirements of BS 6249 Class B both before and after 50 washes at 93° C. as specified in DIN 53920 clause 4.1. The mean phosphorus content of the treated samples was 2.92% with a coefficient of variation of only 5.3%.

EXAMPLE 4

1000 meters of drill fabric was treated as described in Example 1, but with a bath containing 27.0% $THP^+$ ion and a wet pick-up of 74.2%. Curing commenced with an ammonia concentration of 68% and with a speed of 40 meters/min and an ammonia flowrate of 1.8 $NH_3$/P. The temperature rose to 73° C. and the ammonia concentration fell to 36% before rising back to 53%.

17 samples were taken from throughout the run. All the samples met the requirements of BS 6249 Class B both before and after 50 washes at 93° C. as specified in DIN 53920 clause 4.1. The mean phosphorus content of the treated samples was 2.67% with a coefficient of variation of only 3.3%.

EXAMPLE 5

500 meters of white cotton sheeting weighing 178 g/m$^2$ and 1.52 meters wide were treated as described in Example 4 but with a wet pick-up of 92.9%. Curing was carried out immediately after the process of Example 4, so that the starting conditions were ammonia concentration 53%, temperature 73° C., speed 40 meters/min and ammonia flowrate 2.16 $NH_3$/P. The temperature remained steady at 73 to 74° C. but the ammonia concentration rose to 82%.

10 samples were taken from throughout this run. All the samples met the requirements of BS 6249 Class B both before and after 50 washes at 93° C. as specified in DIN 53920 clause 4.1. The mean phosphorus content of the treated samples was 2.83% with a coefficient of variation of only 2.5%.

EXAMPLE 6

1000 meters of drill fabric were treated as described in Example 4 but with cooling of the recirculated gases. The bath contained 26.2% $THP^+$ ion and the wet pick-up was 84%. The initial ammonia concentration was 82%, the curing speed was 48 meters/min and the ammonia flowrate was 1.7 $NH_3$/P. The temperature rose to 67° C. and the ammonia concentration fell to 52% before rising to 55%.

8 samples were taken from throughout this run. All the samples met the requirements of BS 6249 Class B both before and after 50 washes at 93° C. as specified in DIN 53920 clause 4.1. The mean phosphorus content of the treated samples was 2.85% with a coefficient of variation of only 4.7%.

EXAMPLE 7

3500 meters of narrow width cotton sheeting weighing 178 g/m$^2$ and 0.96 meters wide was treated as described in Example 6 but with a bath containing 30.2% $THP^+$ ion and a wet pick-up of 68%. The initial ammonia concentration was 78%, the curing speed was 52 meters/min and the ammonia flowrate was 2.1 $NH_3$/P. The temperature rose to 58° C. and the ammonia concentration fell to 37% before rising to 43%.

11 samples were taken from throughout this run. All the samples met the requirements of BS 6249 Class B both before and after 50 washes at 74° C. as specified in BS 5651:1989 clause 6.5.3. Washed samples were also recorded as not ignited when tested by BS 7175 Section 3: Ignitability of individual Bedcovers, when using ignition sources 0, 1 and 5. The mean phosphorus content of the treated samples was 2.79% with a coefficient of variation 9.2%.

EXAMPLE 8

9000 meters of narrow width cotton sheeting was treated as described in Example 7, but with a bath containing 21.7% $THP^+$ ion and a wet pick-up of 81%.

Curing was carried out in three batches with a curing speed of 53 meter/min and an ammonia flowrate of 2.1 $NH_3$/P. For all three batches the temperature rose to an equilibrium value of 58 to 60° C. and the ammonia centration fell to within the range 45 to 50%.

13 samples were taken from throughout this run. All the samples met the requirements of BS 6249 Class B both before and after 3 washes at 74° C. as specified in BS 5651:1989 clause 6.5.3. The mean phosphorus content of the treated samples was 2.54% with a coefficient of variation of only 3.8%.

I claims:

1. A process for the flame-retardant treatment of a cellulosic fabric, said process consisting essentially of:

(a) impregnating said fabric with an aqueous solution of a tetrakis (hydroxyorgano) phosphonium (THP) composition selected from the group consisting of
(i) THP salts;
(ii) partially-neutralized THP salts;
(iii) mixtures of THP salts and nitrogen-containing compounds; and
(iv) precondensates of THP salts and nitrogen-containing compounds; said solution containing from 5% to 50% by weight of $(THP)^+$ ions;

(b) at least partially drying said impregnated fabric;

(c) contacting said at least partially dried impregnated fabric with a gas including ammonia in an apparatus, by passing said fabric at a speed of 30 to 100 m/minute once through a chamber of said apparatus and thereby subjecting said fabric to a single cure, said apparatus comprising entry and exit points for said fabric, respectively into and out of said chamber, and at least one duct located within said chamber, said at least one duct having at least one orifice extending over the width of said fabric for delivering the ammonia to said fabric, said fabric being in contact with said at least one duct and being disposed over said at least one orifice, and wherein in said step of contacting said fabric, both moisture contained in said fabric and water produced as a by-product of curing, are volatilized and condensed on an interior wall of said chamber, said condensed water flowing down said interior wall of said chamber to a drain for removal of said condensed water from said apparatus, (d) measuring the rate of ammonia in said gas fed into said chamber, determining the ammonia content of said gas and measuring the temperature within said chamber, for maintaining the initial concentration of ammonia in said gas in the range of 70% to 90% by volume and for maintaining the ratio of ammonia input to said THP composition in the range of at least 1.2 to 1, on the basis of ammonia to phosphorus;

(e) withdrawing said treated fabric from said chamber, (f) removing at least some of said gas from said chamber; and (g) recycling at least some of said gas back into said chamber; and wherein said process further comprise heating the ammonia before contacting the fabric, to a temperature of 10 to 120° C.

2. The process of claim 1, wherein said fabric consists essentially of cellulosic fibres.

3. The process of claim 1, wherein said fabric comprises cellulosic fibres and other fibres, said other fibres being selected from the group consisting of fibres co-blendable with cellulosic fibres and fibres co-weavable with cellulosic fibres.

4. The process of claim 3, wherein said other fibres are selected from the group consisting of:

(i) polyester fibres and (ii) polyamide fibres.

5. The process of claim 4, wherein said fabric comprises at least 30% by weight of cellulosic fibres and up to and including 70% by weight of polyester fibres.

6. The process of claim 3, wherein said other fibres are polylactam fibres.

7. The process of claim 2, wherein said cellulosic fibres are selected from the group consisting of natural cotton, ramie, flax and regenerated fibres.

8. The process of claim 5 wherein said polyester fibres consist essentially of the condensation product of an aliphatic dihydric alcohol and an aromatic dicarboxylic acid.

9. The process of claim 1, wherein said fabric is selected from the group consisting of woven fabrics and core spun yarns.

10. The process of claim 1, wherein said tetrakis (hydroxyorgano) phosphonium (THP) composition has a hydroxyorgano group of the formula $HOC(R^1R^2)$, wherein $R^1$ and $R^2$, which are the same or different, are each selected from hydrogen and alkyl groups having from 1 to 4 carbon atoms.

11. The process of claim 1, wherein said THP salt are selected from the group consisting of THP chloride and THP sulphate, and said nitrogen-containing compound is selected from the group consisting of urea, melamine and methylolated melamine.

12. The process of claim 11, wherein said THP composition is in a concentration of 15% to 25% by weight of $THP^+$ ion in the impregnating solution.

13. The process of claim 11, wherein said ratio is from 1.7:1 to 2.2:1.

14. The process of claim 11, wherein said ratio is from 2.2:1 to 2.7:1.

15. The process of claim 1, which further comprises contacting said fabric with an oxidising agent after the fabric leaves said apparatus.

16. The process of claim 15, wherein said oxidising agent is selected from the group consisting of aqueous solutions of hydrogen peroxide and gases comprising molecular oxygen.

17. The process of claim 15, wherein, after oxidation, said fabric is neutralized by means of an aqueous solution of a base.

18. The process of claim 17, wherein said base is sodium carbonate.

19. The process of claim 17, wherein after neutralization, said fabric is washed with water and dried.

20. The process of claim 1, wherein said tetrakis (hydroxyorgano) phosphonium is tetrakis (hydroxymethyl) phosphonium; said solution contains 15 to 25% by weight of $(THP)^+$ ions; and said ratio is 2.2:1 to 2.7:1.

21. The process of claim 20, wherein the tetrakis (hydroxyorgano) phosphonium composition contains THP hydroxide.

22. The process according to claim 1, wherein the fabric travels at a speed of 50 to 80 m/minute.

23. The process of claim 1, wherein, the contacting of the at least partially dried impregnated fabric with gas including ammonia to subject the fabric to a single cure, is accomplished at a temperature of 58 to 60° C. and an ammonia concentration by volume of 45 to 50%.

24. The process of claim 1 wherein the ammonia is heated to a temperature below 100° C.

25. The process of claim 24 wherein the ammonia is heated to a temperature above about 40° C.

26. The process of claim 25 wherein the ammonia is heated to a temperature in the range of about 40° C. to about 60° C.

27. The process of claim 26 wherein the ammonia is heated to a temperature in the range of about 40° C. to about 50° C.

* * * * *